US006874415B2

(12) United States Patent
Hoffmann et al.

(10) Patent No.: US 6,874,415 B2
(45) Date of Patent: Apr. 5, 2005

(54) MOUNTING CYLINDER FOR MOUNTING CYLINDRICAL EMBOSSING TOOLS FOR EMBOSSING ROLLS

(75) Inventors: Lars Hoffmann, Freising (DE); Andreas Pretsch, Holzkirchen (DE); Andreas Radler, Hofolding (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 10/761,429

(22) Filed: Jan. 22, 2004

(65) Prior Publication Data

US 2004/0255804 A1 Dec. 23, 2004

(30) Foreign Application Priority Data

Jan. 31, 2003 (DE) ..... 103 04 117

(51) Int. Cl.[7] ..... B41F 13/22; F28F 5/02

(52) U.S. Cl. ..... 101/217; 101/375; 492/46

(58) Field of Search ..... 101/375, 376, 101/383, 6, 23, 216, 217, 219, 407.1, 487, 409; 492/46, 59

(56) References Cited

U.S. PATENT DOCUMENTS 3,753,276 A * 8/1973 Reisch ..... 492/59
5,819,657 A 10/1998 Rossini
5,984,848 A * 11/1999 Hyllberg et al. ..... 492/46
6,377,772 B1 * 4/2002 Chowdry et al. ..... 399/302
6,688,223 B1 * 2/2004 Dauner ..... 101/217
6,810,800 B1 * 11/2004 Schneider et al. ..... 101/217

FOREIGN PATENT DOCUMENTS

DE 250 448 C 10/1911
DE 198 46 033 4/2000
GB 2 343 732 A 5/2000

* cited by examiner

*Primary Examiner*—Eugene H. Eickholt
(74) *Attorney, Agent, or Firm*—Rothwell, Figg, Ernst & Manbeck, PC

(57) ABSTRACT

A mounting cylinder (1) for mounting cylindrical embossing tools for embossing rolls for embossing diffraction gratings or holograms includes a mounting shell (3) for mounting the embossing tool and a fixing device for fixing the mounting shell (3) on a shaft (2) and a tempering device for tempering the mounting shell. According to one variant, the embossing tool is expanded by compressed air in order to be slipped onto the mounting shell or removed therefrom, a compressed air channel system (8) with radial compressed air discharge openings (11) extending axially and/or tangentially within the mounting shell (3). According to another variant, the mounting shell is expanded mechanically in order to fix a embossing tool slipped over the mounting shell and simultaneously fix the mounting shell (3) on the shaft (2).

18 Claims, 3 Drawing Sheets

MOUNTING CYLINDER FOR MOUNTING CYLINDRICAL EMBOSSING TOOLS FOR EMBOSSING ROLLS

BACKGROUND OF THE INVENTION

1. Field of the Invention

The present invention relates to field of mounting cylindrical embossing tools for embossing rolls.

2. Description of the Background Art

This invention relates to a mounting cylinder and a method for mounting cylindrical embossing tools for embossing rolls, in particular for embossing diffraction gratings or holograms on plastic foils and other substrates. Such embossing tools have a partially or completely structured surface which, after the embossing tool has been mounted on the mounting cylinder, is molded into an embossing lacquer by the endless rotary method. Because the lacquer layer into which embossing is done is relatively thin, it is preferable to use "endless" embossing tools that do not have either an abutting edge or butt joint or a bulky seam.

Mounting cylinders for similar purposes are known from printing technology. However, the printing forms used here that are mounted on the mounting cylinder are thick-walled and very massive, so that the mounting cylinder is accordingly adapted mechanically due to the high clamping powers occurring during mounting. Printing technology uses for example very flexible printing forms made of rubbery materials which require different mounting mechanisms. Some printing processes also use thin metallic plates as printing forms, which are mounted e.g. magnetically and in abutting relationship. Mounting cylinders from printing technology are therefore unsuitable for embossing diffraction gratings and holograms, since the embossing tools used for embossing, which are usually made of nickel, exist as tubular, thin-walled so-called sleeves with a wall thickness of only a few tenths of a millimeter. Mounting the thin-walled sleeve on the mounting cylinder can be done according to different principles.

According to one principle, the mounting cylinder or at least its outer, cylindrical mounting shell is cooled from inside, for example by continuous flushing with liquid nitrogen. The mounting cylinder or mounting shell is made of material with a high heat expansion coefficient, for example aluminum, so that its outside diameter shrinks accordingly due to cooling. In this state the cylindrical sleeve can be easily drawn over the mounting cylinder or shell. After the end of nitrogen cooling the diameter expands back to its original value due to heating. This causes the surface of the mounting cylinder or shell to come in direct contact with the sleeve and tightly mount it. This principle is mentioned for example in DE 100 49 283 A1.

According to another principle, the sleeve is expanded elastically by compressed air, an air cushion being created between the mounting cylinder surface and the sleeve via which the sleeve can be easily slipped onto the mounting cylinder and removed therefrom. Switching off the compressed air causes the sleeve to contract radially and come to rest on the surface of the mounting cylinder, thereby being firmly mounted on the surface. This principle is also mentioned in DE 100 49 283 A1.

In connection with the aforementioned principles for mounting a sleeve, for example using compressed air, DE 101 02 269 A1 describes a method for mounting and dismantling a shell without the whole carrier roll having to be removed from the plant. Accordingly, a bearing of the cylinder shaft is merely swung out so that the shell can be slipped onto a carrier core of the mounting cylinder or removed from said core over the swung out, free end of the shaft.

While forms for printing technology are usually not tempered during the printing process, tempering of embossing tools is of essential importance for embossing diffraction gratings and holograms in order to achieve good transfer and good embossing results when embossing the optically diffractive structures. If embossing is done in radiation-crosslinking lacquers for example, it can be necessary to remove polymerization heat to avoid overheating of the substrate. In the case of heat curing lacquers, however, the supply of heat can be required. Therefore, adequate tempering of the sleeve is of particular importance for embossing optically diffractive structures.

For heat curing systems, DE 100 39 744 A1 proposes instead of an external supply of heat an internal tempering of the embossing tool ("sleeve") by which during the embossing process the embossing tool is brought from inside to a temperature determined as optimal. The mounting cylinder described therein comprises a hollow shaft, a mounting shell with an outer surface for mounting the cylindrical embossing tool and two holding devices on the faces for fixing the mounting shell coaxially on the shaft. The mounting shell is tempered from inside by a tempering medium, in particular water, which is passed through a first channel of the hollow shaft into a hollow space between the shaft and the mounting shell and passed out of the hollow space again through a second channel disposed coaxially with the first channel in the hollow shaft. This causes the mounting shell and simultaneously also the embossing tool mounted on the shell to be tempered from inside.

In addition to the connections for the tempering medium at one end of the shaft, a compressed air inlet is integrated into the shaft at the other end of the shaft. Compressed air is branched in the radial direction by the holding device on the face and passed on through pipes extending in the axial direction in the hollow space between the shaft and the mounting shell to different through bores extending radially through the mounting shell. The compressed air exits through said bores at different places on the surface of the mounting shell, creating a compressed air cushion by which a embossing tool to be mounted is expanded radially and on which the embossing tool can be easily slipped over the mounting shell and removed therefrom.

However, the above-described mounting cylinder is of extremely complex structure. When the embossing plant is reset to a embossing tool with a different diameter in case of a format change, a whole new mounting cylinder is required. This is not only cost-intensive but also time-consuming, since it is in each case necessary to completely remove the shaft axle, thereby also separating the shaft axle from the connections for compressed air and tempering medium.

SUMMARY OF THE INVENTION

It is the problem of the present invention to propose a simply constructed mounting cylinder that can be tempered from inside, on the one hand, and is easy to reset from one embossing tool to another embossing tool, in particular with different diameters, on the other hand, as well as a method for mounting cylindrical embossing tools.

According to a first variant in which the embossing tool or sleeve is expanded by compressed air for slipping on and removal, it is provided that the compressed air pipes extend within the mounting shell. For this purpose a pipe system extends within the mounting shell in the axial and/or tangential direction between at least one compressed air feed opening and the radial compressed air discharge openings.

Integration of the compressed air pipes into the mounting shell of the mounting cylinder substantially facilitates replacement of the mounting shell. In particular, it is unnecessary to replace the whole mounting cylinder when a mounting shell with a greater outside diameter is merely to be used for mounting a embossing tool of greater diameter. The driveshaft and the fixing device for fixing the mounting shell coaxially with the driveshaft can be retained.

The compressed air feed can fundamentally lead through the driveshaft and further in the radial direction through the holding device for fixing the mounting shell on the driveshaft up to the mounting shell, similarly to the principle described in DE 100 39 744 A1. However, an embodiment of the invention that is preferred in terms of production engineering provides that the compressed air feed opening is located on an axial face of the mounting shell. Compressed air can then be passed into the connection on the face through flexible tubes for changing the embossing tool. A further advantage thereby achieved is that the sleeve can also be slipped onto the mounting shell and removed therefrom outside the embossing plant when the mounting cylinder is so formed that the mounting shell is detachable therefrom as a whole, as proposed for example in DE 101 02 269 A1 by swinging out a bearing of the mounting cylinder shaft.

The pipe system for the compressed air pipes can be realized as a channel pipe system in the mounting shell. The term "channel pipe system" refers in the present context to a pipe system integrated in the solid material of the mounting shell. Such a channel pipe system can for example be drilled into the mounting shell existing as a simple hollow cylinder. The mounting shell can also be formed by two coaxial and directly adjoining hollow cylinders, the channel system being milled into the inner surface of the outside hollow cylinder and/or into the outer surface of the inside hollow cylinder.

According to an alternative embodiment, the mounting shell is formed as a double-walled hollow cylinder, the pipe system for the compressed air pipes being realized as a pipe system within the space formed between the cylinder walls. The pipe system can be constructed similarly to the pipe system described in DE 100 39 744 A1 but is located in contrast thereto within the mounting shell and is therefore removed from the driveshaft together with the mounting shell in simple fashion in case of a format change.

The latter variant, in which the mounting shell is formed as a double-walled hollow cylinder, can be combined with a tempering device in effective fashion by using the space between the two cylinder walls for receiving tempering fluid. The outer hollow cylinder of the mounting shell can thus be tempered to an optimal temperature over its whole surface from inside by tempering fluid passed into the space.

On the other hand, the tempering device can be realized within the space between the two cylinder walls as a pipe system through which tempering fluid is passed. However, in this case the heat transfer from tempering fluid to the outer hollow cylinder of the mounting shell is less effective and in particular distributed nonuniformly over the surface.

However, if the mounting shell exists as a solid body into which the compressed air pipes are integrated as a channel pipe system, as explained above, pipes for tempering fluid can also be realized therein as a channel pipe system in corresponding fashion.

Finally, it is also possible not to integrate the tempering device into the mounting shell itself but, as described in DE 100 39 744 A1, to seal the hollow space between the shaft and the mounting shell in the axial direction for receiving tempering fluid in said hollow space. For this purpose, the shaft can be hollow for supplying and removing tempering fluid. The shaft preferably comprises separate feed and discharge pipes so that tempering fluid can flow through the hollow space continuously.

However, flow through the mounting shell itself instead of through a hollow space formed between the mounting shell and the shaft offers different advantages. Firstly, the tempering of the outer mounting shell surface is only negligibly dependent on the thickness of the mounting shell. That is, upon a format change from a cylindrical embossing tool (sleeve) with a comparatively small diameter to a embossing tool with a comparatively great diameter, it is merely necessary to replace a thin-walled mounting shell with an accordingly thicker-walled mounting shell, without this having an essential effect on the tempering of the mounting shell surface. Furthermore, the structure of the shaft is substantially less complicated, which has a positive effect on the production cost and stability of the shaft. In addition, it is unnecessary to empty tempering fluid from the system before changing one mounting shell for another mounting shell, since the system is hermetically sealed assuming the use of suitable, in particular self-closing, valves. Finally, integration of the tempering device into the mounting shell offers sealing advantages, since it is merely necessary to seal the feed and discharge connections, which is no problem using suitable valves. It is substantially more troublesome, in contrast, to seal the hollow space between the shaft and the mounting shell for receiving tempering fluid.

For fixing the mounting shell coaxially on the shaft it is preferable to use pressure sleeves seated on the shaft which expand radially through axial clamping, thereby clamping the mounting shell on the pressure sleeve and thus on the shaft. Alternatively, the mounting shell can be fixed using clamping jaws mounted on the shaft, as explained below in connection with a second variant of the invention.

The second variant of the invention relates to a mounting cylinder for which the sleeve is expanded mechanically to fix it on the mounting cylinder. In this case, the fixing device does not serve only to fix the mounting shell on the shaft. Rather, the mounting shell is expanded by the fixing device radially to such an extent that not only the mounting shell is clamped on the fixing device but also a sleeve slipped over the mounting shell is clamped on the thus expanded mounting shell.

The mounting shell cannot always be expanded using pressure sleeves available on the market, at best in the case of very thin-walled mounting shells. A more suitable fixing device for this second variant of the invention is therefore the use of clamping jaws. Clamping jaws permit substantially greater mechanical forces to be applied to the mounting shell radially from inside. This makes it especially simple to expand mounting shells of different thickness but roughly the same inside diameter, so that the same clamping jaws can be used for mounting shells with different outside diameters. For other diameter ranges the clamping jaws can be replaced by accordingly adapted clamping jaws. Thus, all desired sleeve diameters can be used with one shaft by replacing either only the mounting shell or the mounting shell with the clamping jaws.

Tempering of the mounting shell can be realized in the same way as described with respect to the first variant of the invention. That is, either a hollow space between the shaft and the mounting shell can be flushed with tempering fluid, using a hollow shaft for feeding and discharging the fluid. Or the tempering device is integrated into the mounting shell itself, in the form of cooling coils, channels, bores or the like, as explained above.

The mounting shell is preferably made of aluminum or an aluminum alloy. Aluminum combines some essential material properties, having a high coefficient of thermal conduction, on the one hand. Aluminum is comparatively elastic, on the other hand, permitting the mounting shell to be expanded elastically without great effort for tightly clamping the mounted sleeve. Furthermore, aluminum can be easily machined due to its low strength, so that the outside diameter of the mounting shell can be precisely adjusted in simple fashion by truing the outer surface.

It holds quite generally for all variants, in particular the first variant, that the outermost surface of the mounting shell is preferably surface-treated to protect it from mechanical damage during mounting of the sleeves. The surface treatment is preferably coating with mechanically hard material (hard-coating), such as sintered metal, ceramic compounds, etc.

BRIEF DESCRIPTION OF THE DRAWINGS

In the following the invention will be described by way of example with reference to the accompanying figures, in which.

DETAILED DESCRIPTION OF THE INVENTION

Figure 1:
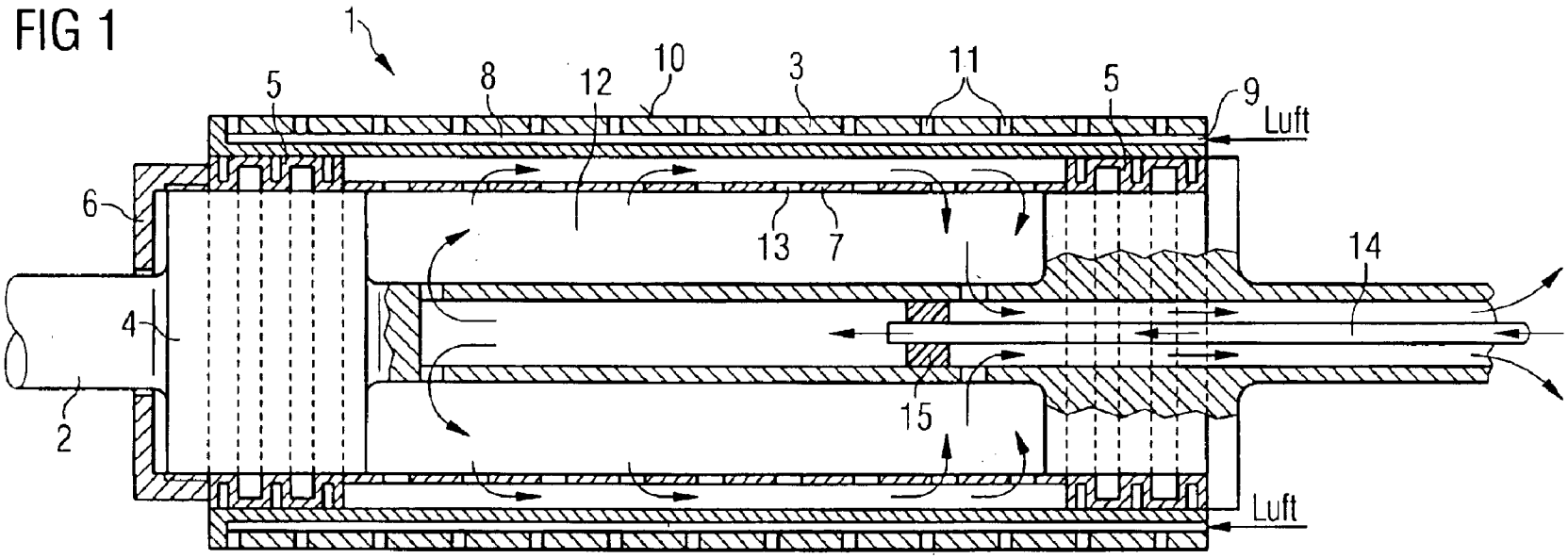
FIG. 1 shows schematically a mounting cylinder according to a first embodiment of the first variant of the invention.

FIG. 1 shows a mounting cylinder according to a first embodiment of the first variant of the invention. The representation in FIG. 1 only shows the construction schematically, omitting components irrelevant to the invention. Mounting cylinder 1 comprises driveshaft 2 and mounting shell 3 mounted by fixing devices 5 on two shaft shoulders 4 of wider diameter.

Fixing device 5 is executed as a pressure sleeve here and works according to the principle that axial compression of the pressure sleeve causes radial expansion thereof. The axial compression force is applied to pressure sleeve 5 shown on the left in FIG. 1 by means of schematically shown adjusting nut 6, and transferred to pressure sleeve 5 disposed on the opposite end of the shaft by means of spacer tube 7, so that both pressure sleeves 5 are compressed axially and thus expanded radially to the same extent by adjusting nut 6. Mounting shell 3 can thus be slipped onto pressure sleeves 5 with or without a mounted sleeve, and clamped with pressure sleeves 5 and thereby fixed on shaft 2 by tightening of adjusting nut 6. Mounting shell 3 can be removed from shaft 2 again in reverse fashion.

When the sleeve (not shown in FIG. 1) is mounted on mounting shell 3, mounting cylinder 1 can be used as an embossing roll or embossing cylinder in an embossing plant. The sleeve can be mounted on mounting shell 3 before or after the shell is mounted on shaft 2. For this purpose, mounting shell 3 contains compressed air pipe system 8 with one or more compressed air feed openings 9 on one face of shell 3 and with radial compressed air discharge openings 11 distributed over surface 10 of shell 3. Compressed air feed openings 9 on the face have a connection system (not shown) for connecting a compressed air feed pipe. However, it is also conceivable to modify the fixing device so that the compressed air feed to compressed air pipe system 8 of mounting shell 3 is effected through shaft 2 into the radially inside surface of shell 3. As explained at the outset, the sleeve is expanded, when slipped onto mounting shell 3, by compressed air exiting from mounting shell surface 10 and can be mounted on shell 3 in simple fashion on the air cushion arising between the sleeve and shell 3. When the compressed air is switched off, good areal contact arises between shell 3 and the mounted sleeve, thereby fixing the sleeve on shell 3 by friction.

"Compressed air" refers according to the present invention to any gaseous medium that is suitable for the above-described purposes.

In mounting cylinder 1 shown in FIG. 1, mounting shell 3 is fixed by two pressure sleeves 5 at the two axial ends of shell 3. In case of longer mounting shells it can be expedient to support mounting shell 3 at more than two places. For this purpose, three or more fixing devices 5 are distributed over the axial length of shaft 2.

Mounting shell 3 is cooled from inside by tempering fluid. For this purpose, the first embodiment of the first variant of the invention, shown in FIG. 1, provides axially sealed hollow space 12 between shaft 2 and mounting shell 3 through which tempering fluid, for example water, is passed. To prevent space 12 from being separated from mounting shell 3 by spacer tube 7, spacer tube 7 has numerous passages 13 through which tempering fluid comes in contact with the inner surface of shell 3. The flow of tempering fluid is indicated with arrows in FIG. 1. Through feed pipe 14 in hollow shaft 2 tempering fluid is passed to one end of space 12, flows through space 12 and is removed through hollow shaft 2 coaxially with feed pipe 14. Seal 15 in hollow shaft 2 is provided to prevent a short circuit of flow.

Mounting shell 3 is preferably made of aluminum, an aluminum alloy or another material with a high coefficient of thermal conduction for tempering a sleeve mounted on shell surface 10 as effectively as possible by means of tempering fluid flowing through hollow space 12, that is, either cool it, if embossing is done for example into exothermally crosslinking lacquers, or heat it, if embossing is done into heat curing lacquers. Heat is conducted well in mounting shell 3 due to its small wall thickness, so that fast tempering is achieved during operation of the embossing plant. The operating point of the plant is rapidly reached, losses of time are minimized during start-up.

Feed and discharge of tempering fluid are effected through a two-way rotor sealing head (not shown) mounted on the corresponding side of the driveshaft. Such a rotor sealing head as well as pressure sleeves 5 are customary, commercially available parts.

In the case of a format change to a sleeve with another diameter, it is merely necessary to replace mounting shell 3 with a mounting shell having a corresponding outside diameter, without having to remove shaft 2 from the embossing plant. For example, shell 3 can be removed from shaft 2 in the way explained in DE 101 02 269 A1 mentioned at the outset, by merely swinging out one end of shaft 2, expediently the end remote from the rotor sealing head. Merely the inside diameter of the mounting shells is given by the geometry of the fixing device. The outside diameter is selectable within a certain range as long as effective heat transfer through the mounting shell is possible. As of a certain thickness of shell 3 it is expedient also to use different pressure sleeves with an accordingly greater outside diameter when replacing the shell. The pressure sleeves can also be replaced without removing the shaft and without adapting the compressed air and/or tempering fluid pipe system at all. A new production of a whole mounting cylinder is thus unnecessary upon a format change, since the whole inner structure of the mounting cylinder is retained.

Figure 2:
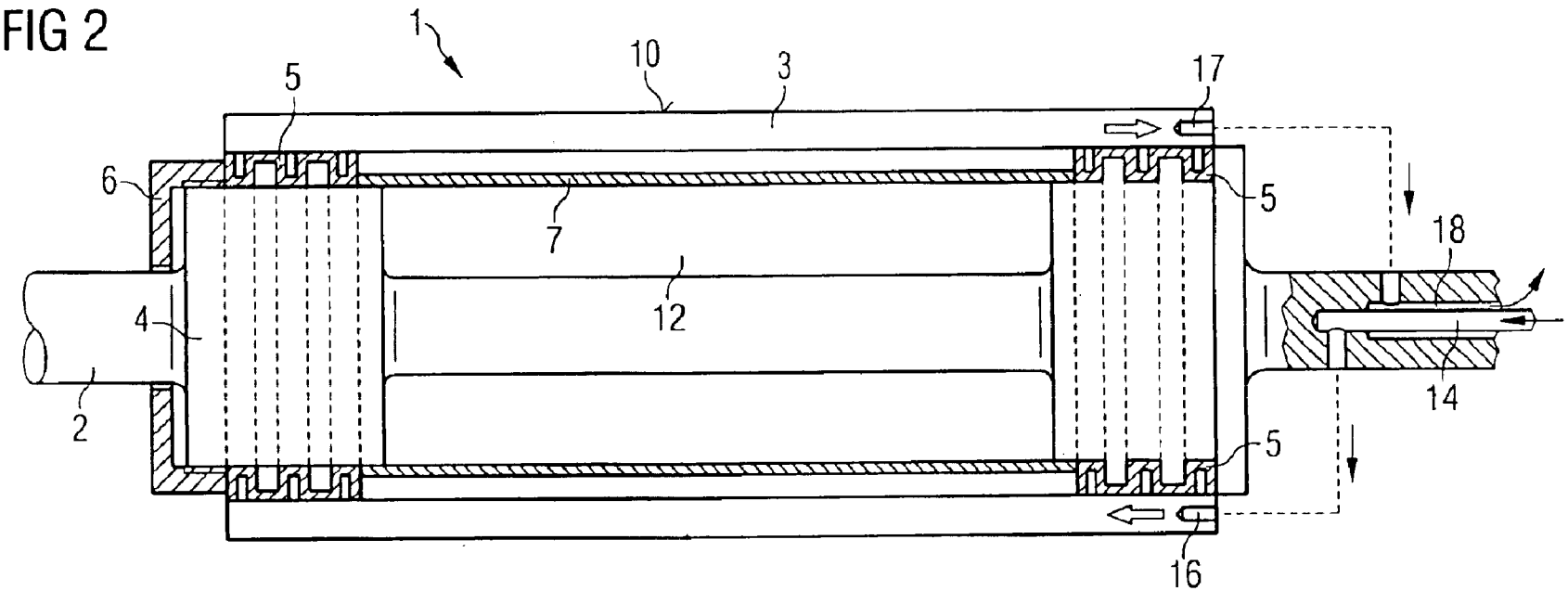
FIG. 2 shows schematically a mounting cylinder according to a second embodiment of the first variant of the invention.

FIG. 2 shows a second embodiment of a mounting cylinder according to the first variant of the invention. Said second embodiment is optimized over the embodiment according to FIG. 1 insofar as the constructional effort for tempering is reduced and tempering is also more effective. As in the embodiment according to FIG. 1, mounting shell 3 is mounted on pressure sleeves 5 that are spaced apart by spacer tube 7 and compressed axially by adjusting nut 6 so that they expand radially, thereby tightly clamping slipped-on shell 3 on shoulders 4 of shaft 2.

In contrast to the embodiment shown in FIG. 1, however, hollow space 12 between shaft 2 and mounting shell 3 does not have tempering fluid flow through it, but tempering fluid is passed through mounting shell 3 itself. For this purpose, mounting shell 3 has at least one feed opening 16 and at least one discharge opening 17 for feeding and discharging tempering fluid. Shaft 2 is hollow only in a front area and has coaxial feed and discharge pipes 14, 18 that in turn lead to a two-way rotor sealing head (not shown). From feed pipe 14 and discharge pipe 18 tempering fluid is passed outside mounting cylinder 1 for example through flexible tubes, which are only indicated schematically by dash lines in FIG. 2, to feed opening 16 of mounting shell 3 and passed back from discharge opening 17 of shell 3 to shaft 2.

Feed and discharge openings 16, 17 are preferably executed as quick coupling valves which automatically close in the uncoupled state. This achieves two advantages. On the one hand, the tempering system can be quickly decoupled from mounting shell 3, so that mounting shell 3 can be rapidly changed with or without a mounted sleeve and, on the other hand, it is unnecessary to previously empty the tempering system for changing mounting shell 3. Tempering fluid can instead remain within shell 3.

The sleeve is mounted on mounting shell 3, as in the embodiment according to FIG. 1, by compressed air through a compressed air pipe system integrated into shell 3, which is not explicitly shown in FIG. 2. Mounting shell 3 can be constructed in different ways for this purpose.

According to a first alternative, mounting shell 3 is formed by a hollow cylinder, which also refers to two or more coaxially telescoped hollow cylinders, whose outside and inside diameters are accordingly adapted to each other. The compressed air and tempering fluid pipe systems are then integrated, for example milled or drilled, into said hollow cylinder as channel pipe systems.

According to a second alternative, the mounting shell consists of a double-walled hollow cylinder, both the compressed air pipe system and the tempering fluid pipe system being realized as pipe systems within the space between the two cylinder walls. The tempering fluid pipe system can be formed for example by one or more tempering coils.

According to a third alternative, mounting shell 3 again consists of a double-walled hollow cylinder but only the compressed air pipes are realized as a pipe system within the space between the two cylinder walls and the space otherwise has tempering fluid flow through it substantially unhindered. Dividing walls can be provided within the space that guarantee a chamber-like or labyrinthine, in particular meandering, guidance of tempering fluid through the space from feed opening 16 to discharge opening 17 to avoid a short circuit of flow between feed and discharge openings 16, 17.

Tempering of mounting shell surface 10 can be adjusted especially quickly with mounting shell 3 shown in FIG. 2 because, in contrast to the embodiment according to FIG. 1, not the whole shaft is tempered but only mounting shell 3. This permits a stationary operating state to be reached more rapidly during foil embossing.

Figure 3:
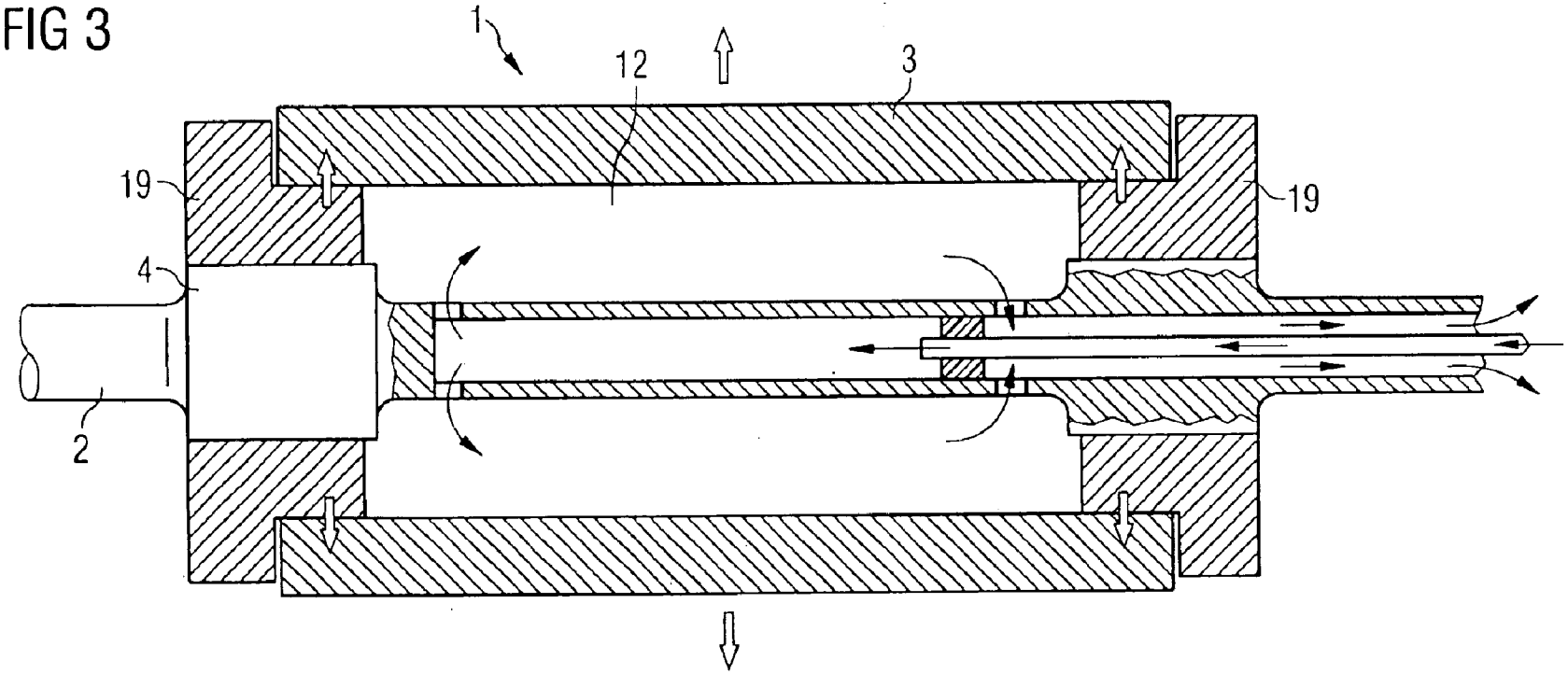
FIG. 3 shows schematically an embodiment of the second variant of the invention.

FIG. 3 shows an embodiment according to the second variant of the invention. The essential difference over the embodiments according to FIGS. 1 and 2 consists in the way a sleeve is mounted on mounting shell 3. In contrast to the above-described embodiments, the sleeve is not expanded by compressed air to be able to be slipped over shell 3, but shell 3 at first has a smaller diameter than the sleeve at ambient temperature so that the sleeve can readily be mounted on shell 3. Only then is shell 3 radially expanded by clamping jaws 19 so that the sleeve slipped onto shell 3 is fixed.

Clamping jaws 19 perform two functions here. The first function is to mechanically fix shell 3 on shoulders 4 of shaft 2 by tightening of jaws 19, and the other function is to expand shell 3 by further tightening of jaws 19 and thereby fix a sleeve slipped onto shell 3, as described above.

Tempering of mounting shell 3 is effected in the same way as explained with respect to the embodiment according to FIG. 1 by flushing tempering fluid through hollow shaft 2 and hollow space 12 between shell 3 and shaft 2. Alternatively, shell 3 can also have tempering fluid flow directly through it, analogously to the embodiment according to FIG. 2.

In the case of longer mounting shells 3, in particular with a length over 400 millimeters, it is expedient to distribute further clamping devices for expanding and supporting shell 3 over the axial length of shaft 2.

Instead of clamping jaws 19 it is also possible to use other clamping or fixing devices, for example the pressure sleeves mentioned with respect to FIGS. 1 and 2, provided they permit sufficient radial forces to be applied to shell 3 for expanding the shell by the desired measure.

The clamping device according to FIG. 3 achieves the same advantages as the clamping devices according to FIGS. 1 and 2. In particular, a format change from one diameter to another diameter is easily possible without the mounting cylinder having to be removed from the embossing plant. Since the inside diameter of mounting shells 3 is given by clamping jaws 19, mounting shells 3 differing only in their outside diameter can be exchanged. The outside diameter of mounting shell 3 is selectable within a range as long as shell 3 can still be expanded mechanically by clamping jaws 19. Thus, upon a format change only the mounting shell and optionally also the clamping jaws have to be adapted while the whole inner structure of the mounting cylinder is retained. In particular, a new production of a whole mounting cylinder is unnecessary upon a format change.

What is claimed is:

1. A mounting cylinder (1) for mounting cylindrical embossing tools for embossing rolls, comprising a shaft (2), a mounting shell (3) having an outer surface (10) for mounting a cylindrical embossing tool, a fixing device (5) for fixing the mounting shell (3) coaxially on the shaft (2), a tempering device for tempering the surface (10) of the mounting shell (3), and a device for detaching the embossing tool from the surface by means of compressed air by at least one compressed air feed opening (9) and radial compressed air discharge openings (11) being provided in the mounting shell (3) through which compressed air can flow out of the surface (10) to expand a cylindrical embossing tool slipped over the mounting shell (3), characterized in that the mounting shell comprises between the at least one compressed air feed opening (9) and the compressed air discharge openings (11) a compressed air pipe system (8) extending at least one of axially or tangentially within the mounting shell (3).

2. A mounting cylinder according to claim 1, characterized in that the at least one compressed air feed opening (9) is located on an axial face of the mounting shell (3).

3. A mounting cylinder according to claim 1, characterized in that the at least one compressed air feed opening (9) is located on a radially inside surface of the mounting shell (3).

4. A mounting cylinder according to claim 1, characterized in that the compressed air pipe system (8) is realized as a channel pipe system within the mounting shell (3).

5. A mounting cylinder according to claim 3, characterized in that the mounting shell (3) is formed as a double-walled hollow cylinder and the compressed air pipe system (8) is realized as a pipe system within the hollow space formed between the cylinder walls.

6. A mounting cylinder according to claim 1, characterized in that the fixing device (15, 19) comprises a pressure sleeve.

7. A mounting cylinder according to claim 1, characterized in that the fixing device (15, 19) comprises a clamping jaw.

8. A mounting cylinder according to claim 1, characterized in that the tempering device comprises between the shaft (2) and the mounting shell (3) an axially sealed hollow space (12) for receiving tempering fluid.

9. A mounting cylinder according to claim 1, characterized in that the tempering device is realized within the mounting shell as a channel pipe system for tempering fluid to flow through.

10. A mounting cylinder according to claim 1, wherein the mounting shell is formed as a double-walled hollow cylinder, at least one feed opening (16) and one discharge opening (17) for feeding and discharging tempering fluid being provided to the space between the cylinder walls.

11. A mounting cylinder according to claim 1, wherein the mounting shell is formed as a double-walled hollow cylinder, the tempering device being realized between the cylinder walls as a pipe system for tempering fluid to flow through.

12. A mounting cylinder according to claim 8, characterized in that the shaft (2) is hollow and is used for feeding and discharging tempering fluid.

13. A mounting cylinder according to claim 12, characterized in that the shaft (2) comprises separate feed and discharge pipes (14, 18) so that tempering fluid can be fed and discharged continuously.

14. A mounting cylinder according to claim 1, characterized in that the mounting shell (3) is made of aluminum or an aluminum alloy.

15. A method for mounting a cylindrical embossing tool for an embossing roll using a mounting cylinder according to claim 1.

16. The mounting cylinder of claim 1 wherein said outer surface is provided with hard-coating.

17. A mounting cylinder (1) for mounting cylindrical embossing tools for embossing rolls, comprising a shaft (2), a mounting shell (3) having an outer surface (10) for mounting a cylindrical embossing tool, a fixing device (19) for fixing the mounting shell (3) on the shaft (2), and a tempering device for tempering the surface (10) of the mounting shell (3), characterized in that the mounting shell (3) is expandable radially by the fixing device (19) such that the mounting shell (3) is firmly clamped on the fixing device (19) and in addition a embossing tool slipped over the mounting shell (3) is firmly clampable on the surface (10) of the mounting shell (3).

18. The mounting cylinder of claim 17 wherein said outer surface is provided with hard-coating.

* * * * *